US005206643A

United States Patent [19]

Eckelt

[11] Patent Number: 5,206,643

[45] Date of Patent: Apr. 27, 1993

[54] SYSTEM FOR MANAGING A PLURALITY OF MOTOR VEHICLES

[75] Inventor: Manfred Eckelt, Mainz, Fed. Rep. of Germany

[73] Assignee: Deutsche Lufthansa Aktiengesellschaft, Cologne, Fed. Rep. of Germany

[21] Appl. No.: 628,388

[22] Filed: Dec. 14, 1990

[30] Foreign Application Priority Data

Dec. 20, 1989 [DE] Fed. Rep. of Germany ..... 3942070

[51] Int. Cl.[5] ..... G08G 1/01

[52] U.S. Cl. ..... 340/932.2; 340/904; 340/928; 194/902

[58] Field of Search ..... 194/902, 212; 235/33, 235/384; 368/111; 377/90; 364/401, 467; 340/932.2, 928, 904

[56] References Cited

U.S. PATENT DOCUMENTS 3,604,898 9/1971 Magnusson ..... 194/902

4,665,395 5/1987 Van Ness ..... 340/928

*Primary Examiner*—Jin F. Ng

*Assistant Examiner*—Edward Lefkowitz

*Attorney, Agent, or Firm*—Robert W. Becker & Associates

[57] ABSTRACT

A system for managing a plurality of motor vehicles that are driven by different people is provided. A parking area having an entrance and an exit is provided with a data acquisition device for controlling user access, as well as a receiver that is disposed in the vicinity of a barrier and that receives vehicle operation data that is transmitted by a transmitter that is integral with the vehicle, with this data being transmitted to a central control unit that controls the barriers, the data acquisition device, and the receiver.

14 Claims, 4 Drawing Sheets

SYSTEM FOR MANAGING A PLURALITY OF MOTOR VEHICLES

BACKGROUND OF THE INVENTION

The present invention relates to a system or arrangement for managing a plurality of motor vehicles that are driven by different people.

Individual passenger traffic continues to clash with public multi-person passenger traffic with respect to the recurring problem of the parking spaces that are necessary for the motor vehicles of individuals. For example, main train stations, airports, etc., must provide a large number of parking spaces in order to provide sufficient parking space for travelers.

In addition to travelers, the employees of the local and long-distant passenger companies also need sufficient spaces for parking their vehicles. In this connection, it must be taken into consideration that, for example at airports, the flying personnel are often gone for several days, so that they need parking spaces for their vehicles for several days.

To save space, it would be advantageous if the flying personnel arrive with rental cars that could be used by other people during the absence of the flying personnel. However, in practice these considerations are difficult to realize since the rental of motor vehicles, the servicing thereof, and maintenance, require an extremely great number of personnel.

It is an object of the present invention to provide a system for managing motor vehicles that requires only a minimal number of personnel yet enables a rapid rental with high reliability against unauthorized use of vehicles.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The system of the present invention is characterized primarily by: a parking area having at least one entrance and one exit, barrier means for securing the at least one entrance and exit, at least one data acquisition device for controlling user access, disposed in front of the barrier means, as viewed in the direction of travel, of at least one of the at least one entrance and exit, at least one receiver, disposed in the vicinity of the barrier means, for vehicle operation data transmitted by a transmitter that is integral with a vehicle, and a central control unit that is connected to the barrier means, the at least one data acquisition device, and the at least one receiver.

The time that a vehicle sits in front of a gate while the entitlement of the user is checked is sufficient for a sender that is integral with the vehicle to transmit vehicle operation data to a receiver that in turn transmits this operation data, which is specific to the vehicle, to a control unit. In addition to operation data that is specific to the vehicle, an identification that is inherent to the vehicle is also preferably transmitted, via which it is possible to check whether or not the identified user has proper access to the vehicle that is standing in front of the gate.

In a manner similar to the process at the exit of the parking lot, at the entrance to the parking lot the data is also monitored in the control unit, so that all data is present for settling the rental process. The settlement of the rental process is preferably effected in a control computer that is connected with the control unit.

The receiver is expediently provided with an antenna loop that is disposed in the roadway of the parking lot and is not sensitive to dirt. Such antenna loops have proven to be reliable in conjunction with traffic lights for motor vehicles.

In order to be able to rapidly drive an entering vehicle to a prescribed parking space, guide means are provided that after entry of the vehicle are activated by the control unit.

Further specific features of the present invention will be described in detail subsequently.

DESCRIPTION OF PREFERRED EMBODIMENTS

Figure 1:
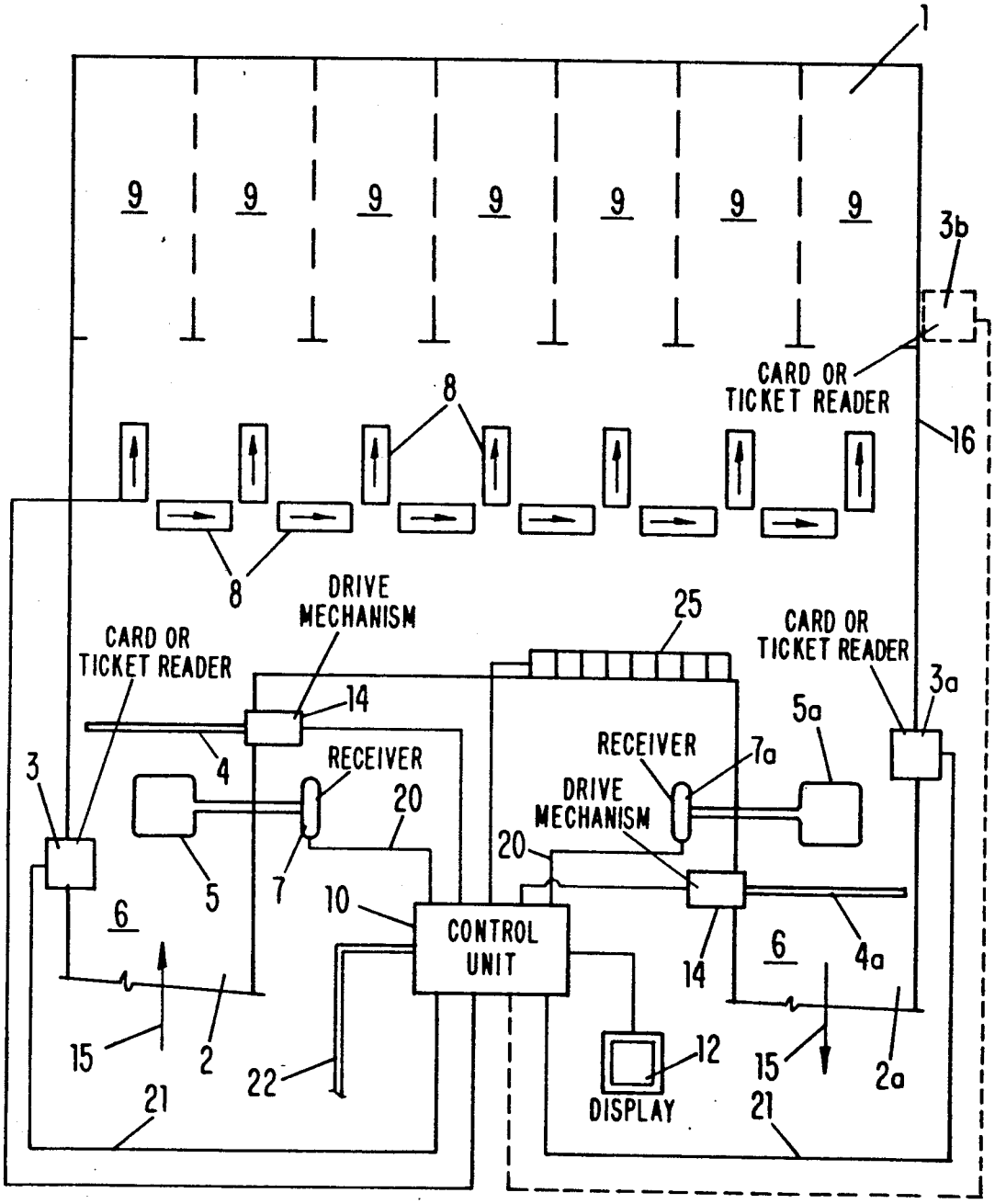
FIG. 1 illustrates one exemplary embodiment of the inventive system for managing motor vehicles.

Referring now to the drawings in detail, in the schematic illustration of the inventive system or arrangement of FIG. 1, the reference numeral 1 designates the parking lot, which could also be a parking garage or the like. The parking lot 1 is enclosed; motor vehicles can enter via an entrance 2 in order to reach the parking spaces 9, and can leave the parking lot 1 via an exit 2*a*. The entrance and exit are secured via a barrier such as a gate 4 and 4*a*, whereby in front of these gates, as viewed in the direction of travel, is disposed a respective card or ticket reader 3 or 3*a* as a data acquisition device. Suitable barriers could also be in the form of roll-up doors, gratings, etc. The gates 4, 4*a* and the card readers 3, 3*a* are coordinated with one another in such a way that the driver of a vehicle that is sitting in front of the gate can reach or operate the card reader 3, 3*a* from the driver's seat through the window of the driver's door.

In place of the card reader 3 or 3*a*, it would also be possible to provide a receiver as a data acquisition device. Such a receiver receives all data that relates to a specific person and serves for the identification of the person entitled to use the vehicle from a low-power transmitter that also relates to a specific person; this transmitter can be the size of a check card.

Disposed between the gate 4 or 4*a* and the card reader 3 or 3*a* in the roadway 6 and ahead of the gate, as viewed in the direction of travel 15, is a respective antenna loop 5, 5*a* that receives from a transmitter 50 that is integral with a vehicle (FIG. 2) transmitted vehicle operation data such as the mileage reading, how full the tank is, if the oil is low, etc., and transmits this data to a receiver 7, 7*a*. The transmitter 50 preferably emits an identification code that is related to the specific vehicle and with which the vehicle can be identified. In the receiver 7, 7*a* the signal is processed and is conveyed via a data line 20 to a control unit 10, which in the illustrated embodiment is a computer, especially a personal computer.

Also connected to the control unit 10 are the drive mechanisms 14 for the gates 4, 4a. Similarly, the card readers 3, 3a are connected to the control unit 10 via data lines 21.

If the parking area is a closed parking garage, it can be advantageous to monitor the access door 16 of the parking garage via the control unit 10, for which purpose a card or ticket reader 3b that is connected to the control unit 10 is disposed next to the access door 16.

The control unit 10 that is associated with the parking lot 1 is connected via a data bus, preferably a series data line 22, with a control computer 100 (FIG. 2) that services or manages a number of parking garage control units or computers 10.

Figure 2:
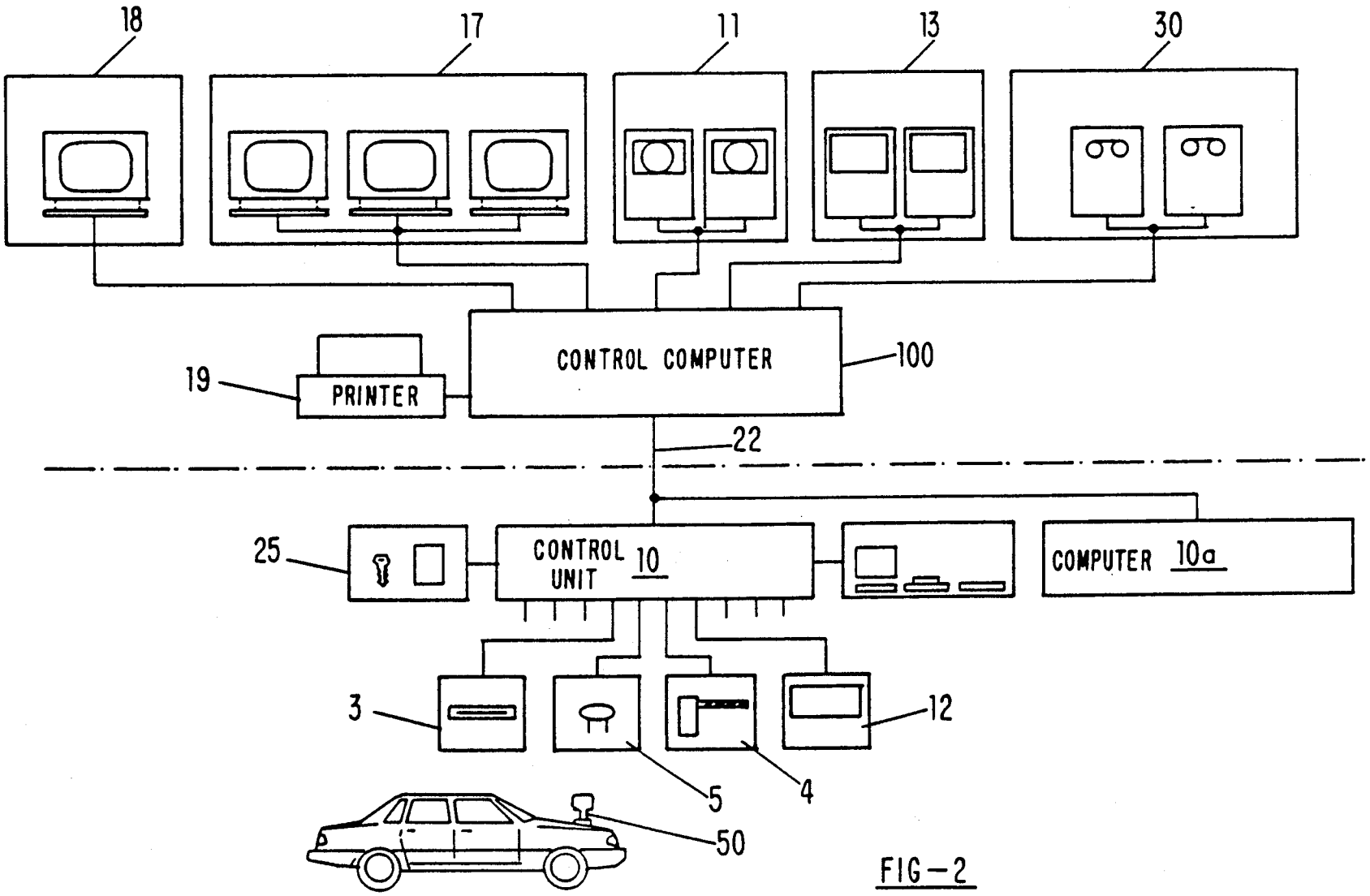
FIG. 2 illustrates the principle of the control unit, along with the peripheral apparatus connected thereto, that are used with the system of FIG. 1.

As can be seen from FIG. 2, the control computer 100 is connected to communication devices or dialogue units 11, so-called Rent-O-Mats, at which the customer, in a dialogue with the control computer 100, can request a rental contract for a desired vehicle. The control computer 100 can be connected with other computers 10a, for example to settle rental procedures. In addition to being connected to terminals 17 for the control process, for the supervisor, or for the operators, the control computer 100 is also connected with a monitoring terminal 18 that, for example via a modem, is periodically coupled with the control computer 100. To be able to print out data, the control computer is furthermore connected to a printer 19.

To rent a vehicle, the customer introduces at the rent-O-Mat 11 his identification card, which can be a conventional credit card, a company identification card, or a special vehicle rental card. The control computer 100 checks the introduced identification card and determines whether this card entitles the user to rent a vehicle. In dialogue with the control computer 100, the customer selects the desired vehicle and receives information concerning where the vehicle is parked. At the conclusion of the dialogue, the control computer 100 imparts the identification data to the control unit 10 of the appropriate parking lot 1 where the vehicle desired by the customer is parked. The data can also be conveyed to other parking lot control units 10a that are connected to the control computer so that the rented vehicle can also be returned to other locations. In conformity with the information given to him, the customer has in the meantime proceeded to the parking lot 1, where he introduces his identification card into the card or ticket reader 3b. The control unit 10 verifies the identification data that is scanned with the data delivered by the control computer 100 and, if this data checks out, releases the access door 16 to the parking lot 1.

To achieve a high reliability against unauthorized use of vehicles, the vehicle keys as well as the respective vehicle documents are locked in a safe system 25 (FIG. 1) that is opened by the control unit 10 after admittance of an authorized customer. Thus, the customer can remove from the safe system the keys and the documents for the vehicle assigned to him, and can then drive this vehicle from one of the parking spaces 9 to the exit 2a. Here the customer must again insert his identification card into the card reader 3a in order to prove that he is authorized to exit. While the vehicle is standing in front of the gate 4a, the transmitter 50 (FIG. 2) that is integral with the vehicle transmits at least the mileage reading and how full the tank is, but preferably also if the oil is low and/or other operational data that is specific to the vehicle, via the antenna loop 5a to the receiver 7a, which transmits this data via the data line 20 to the control unit 10. The transmitter 50 that is integral with the vehicle preferably also emits an identification that is inherent to the vehicle so that the control unit 10 can check whether or not the customer whose identification has been proven has actually taken the vehicle that was assigned to him by the control computer 100. If the scanned characterizing data coincide with the data transmitted from the control computer 100, the drive mechanism 14 for the gate 4a is activated and the exit is opened.

When the rented vehicle is returned, the customer again has to identify himself at the entrance 2 by inserting his identification card into the card reader 3. During this time, the transmitter 50 that is secured to the vehicle transmits not only the vehicle identification but also operation data that is specific to the vehicle, namely the mileage reading and how full the tank is, to the receiver 7 via the antenna loop 5. If the customer and vehicle check out as being authorized to enter, the gate 4 is raised by the drive mechanism 14 and the entrance 2 is opened, while the data that is specific to the vehicle is stored and is assigned to the rental process. The control unit 10 assigns to the vehicle a particular parking space 9, to which the vehicle is guided by guide means 8 that are expediently provided in the parking lot 1. Taking these guide means into consideration, the customer drives the vehicle to the appropriate parking space 9. The guide means 8 is preferably formed by lighted signals that can be disposed not only in the ground but also on the ceiling (of a parking garage).

After the vehicle has been parked, the control unit 10 imparts to the control computer 100, via the series data line 22, the scanned characterizing data that relates specifically to the vehicle and from which the control computer prepares the bill and, where appropriate, prints out the same via the printer 19. It is also possible to have a direct data exchange, for example with the computers of a bank, in order to directly charge the account of the customer.

In order to pass the information on to the customer, it can be advantageous to activate a display 12 via the control unit 10; this display can, for example, be disposed in the entrance and/or the exit.

Figure 3:
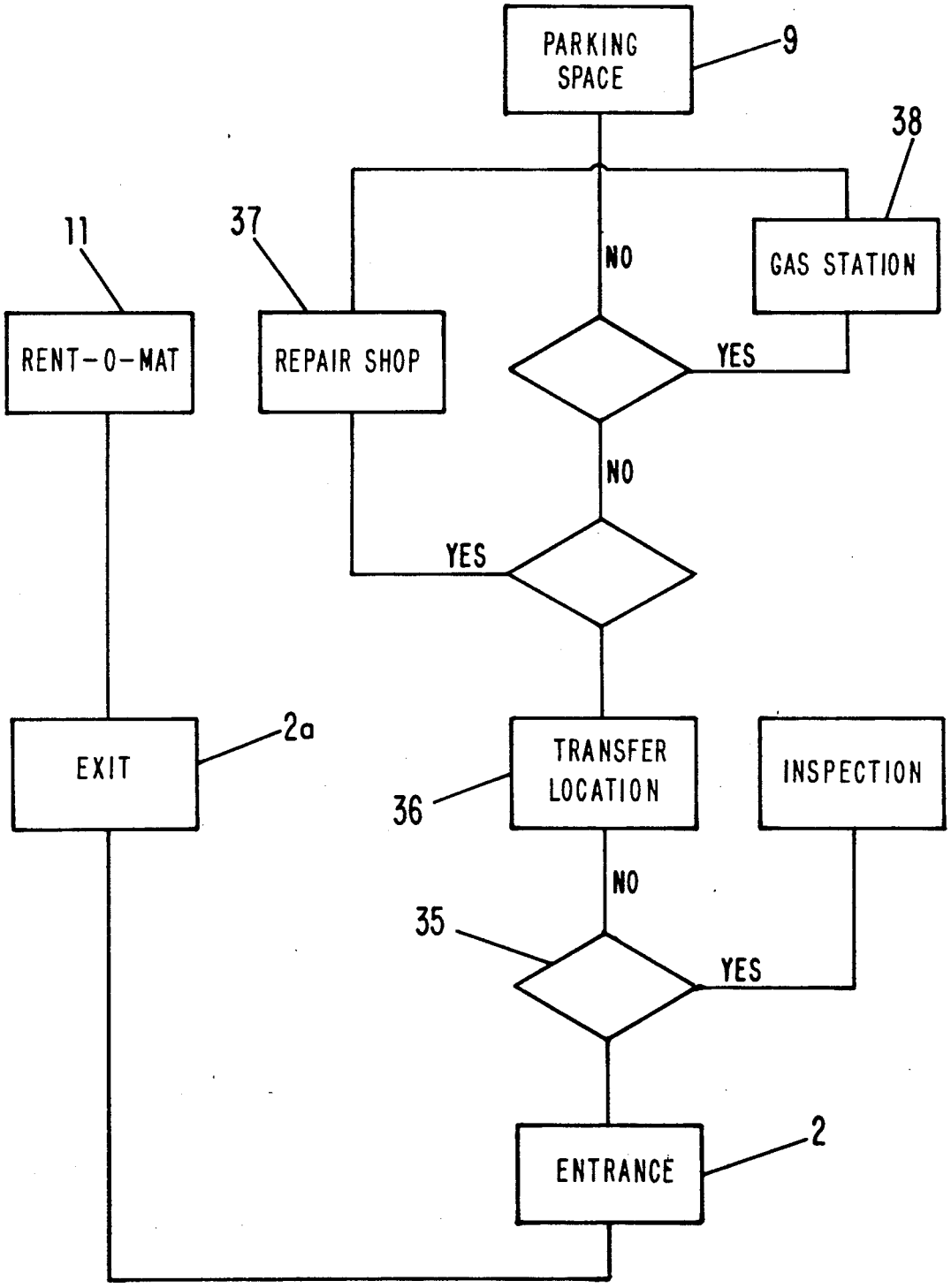
FIG. 3 is an operational sequence diagram showing the operation of the system of FIG. 1.

As illustrated in the operational sequence diagram of FIG. 3, after the entry of a motor vehicle at the conclusion of a rental period it can be advantageous to subject the vehicle to an inspection. For example, if the vehicle had a flat tire during the rental period, the vehicle, in conformity with the decision diamond 35, is delivered for inspection, where the necessary steps for repair or the like are initiated. An entering motor vehicle that has not had a flat tire is subjected at a transfer location 36 to a visual inspection, and the data that is determined thereby is transmitted via a portable data acquisition means 13 (FIG. 2), preferably a radio, to the control computer 100. In conformity with the vehicle inspection that is carried out at the transfer location 36, the vehicle is, if necessary, delivered to a repair shop 37 for repair, maintenance, washing, cleaning of the inside, or to replace operating means. If maintenance is not needed, an inspection is made to see if the gas tank of the vehicle needs to be filled, whereupon the vehicle is then parked in the assigned parking space 9 for the next rental cycle.

Figure 4:
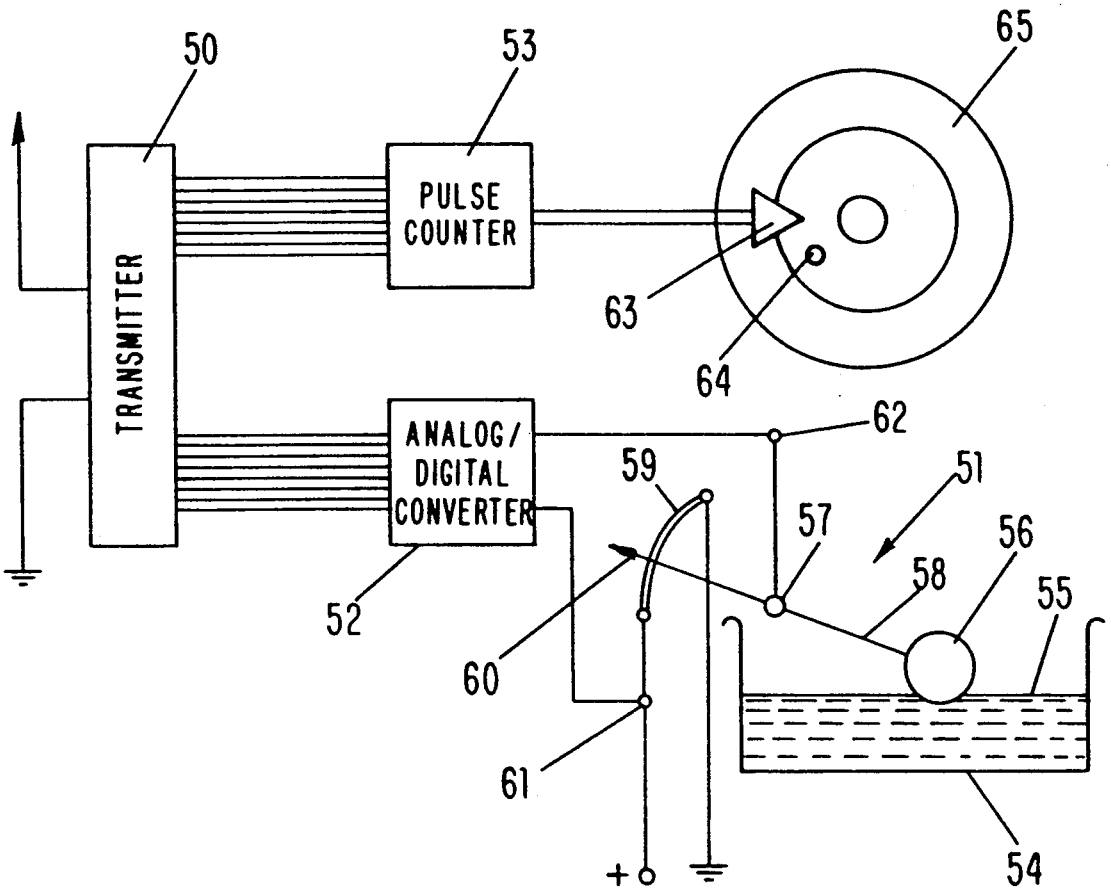
FIG. 4 shows a device for determining vehicle operation data, including a transmitter connected therewith.

FIG. 4 illustrates a mechanism that is integral with the vehicle for determining operational data of the vehicle. Thus, for example, an analog measuring device 51 determines the fluid level in the tank 54 of the vehicle. For this purpose, a float 56 rests upon the liquid level 55; by means of a lever 58 that is pivotable about the pivot point 57, the float moves the pick-up 60 of a slip resistance 59 to which a supply voltage is applied. By shifting the pick-up 60 along the resistance 59, the measuring voltage that can be read between the points 61 and 62 is determined and is conveyed to an analog/digital converter 52 as a value that is proportional to the tank contents. Here the analog proportional value is converted into an 8-bit information that is transmitted in parallel to the transmitter 50, from which it is transmitted as an 8-bit value. After receipt in the receiver 7, 7*a*, this 8-bit information is conveyed to the control unit 10, which in conformity with a stored calibration curve determines the corresponding tank content in, for example, liters for a subsequent settlement or billing.

Since as a consequence of the vehicle identification the control unit has determined the vehicle type, it can recall the respectively required calibration curve from a memory to determine the tank content.

To determine the distance traveled, a pulse counter 53 is provided, the memory content of which is read by the transmitter 50 as an absolute value in 8-bit form. The pulse counter 53 has a sensor 63 that per revolution of a wheel 65 reads a mark 64 that moves past it and emits a pulse.

The present invention is, of course, in no way restricted to the specific disclosure of the specification and drawings, but also encompasses any modifications within the scope of the appended claims.

What I claim is:

1. A system for managing rental processes of a plurality of motor vehicles that are driven by different people, comprising:

a parking area for said vehicles having at least one entrance and one exit;

barrier means for securing said at least one entrance and one exit;

at least one card reader, for controlling user access, disposed in front of said barrier means, as viewed in a direction of travel, of said at least one entrance and one exit;

at least one receiver, disposed in the vicinity of said barrier means, for receiving a vehicle identification code as well as vehicle operation data that is transmitted by a transmitter that is integral with a vehicle; and a central control unit that is connected to said barrier means, said at least one card reader, and said at least one receiver, whereby during exit of a vehicle from said parking area, not only does said central control unit compare identification data read by the pertaining card reader with the vehicle identification code received from the pertaining receiver for controlling said barrier means, but said central control unit also stores vehicle operation data received by said at least one receiver, and whereby during entry of a vehicle into said parking area, not only does said central control unit compare identification data read by the pertaining card reader with the vehicle identification code received from the pertaining receiver for controlling said barrier means, but said central control unit also records vehicle operation data received by said at least one receiver and correlates this recorded vehicle operation data with said vehicle operation data stored during exit of said vehicle in order to settle a rental process.

2. A system according to claim 1, in which said at least one receiver is provided with an antenna loop that is disposed in a roadway of said parking area.

3. A system according to claim 1, in which said central control unit is connected to a control computer.

4. A system according to claim 1, in which said central control unit is a computer.

5. A system according to claim 4, in which said central control unit is a personal computer.

6. A system according to claim 1, in which said at least one data acquisition device is a card reader.

7. A system according to claim 1, in which said at least one data acquisition device is a receiver that receives emitted information.

8. A system according to claim 1, in which said vehicle operation data is transmitted by said transmitter as 8-bit information.

9. A system according to claim 1, wherein said vehicle operation data includes at least mileage reading and how full a fuel tank is.

10. A system for managing a plurality of motor vehicles that are driven by different people, comprising:

a parking area having at least one entrance and one exit;

barrier means for securing said at least one entrance and one exit;

at least one data acquisition device, for controlling user access, disposed in front of said barrier means, as viewed in a direction of travel, of said at least one entrance and one exit;

at least one receiver, disposed in the vicinity of said barrier means, for receiving vehicle operation data that is transmitted by a transmitter that is integral with a vehicle;

a central control unit that is connected to said barrier means, said at least one data acquisition device, and said at least one receiver, with said central control unit being connected to a control computer; and a guide means activated by said central control unit for the return of a vehicle to a prescribed parking space.

11. A system for managing a plurality of motor vehicles that are driven by different people, comprising a parking area having at least one entrance and one exit, barrier means for securing said at least one entrance and one exit;

at least one data acquisition device, for controlling user access, disposed in front of said barrier means, as viewed in a direction of travel, of said at least one entrance and one exit;

at least one receiver, disposed in the vicinity of said barrier means, for receiving vehicle operation data that is transmitted by a transmitter that is integral with a vehicle; and a central control unit that is connected to said barrier means, said at least one data acquisition device, and said at least one receiver, with said central control unit storing and correlating said vehicle operation data in order to calculate and settle a rental process, and with said central control unit also being connected to a control computer, which is connected to a dialogue unit for use by an authorized user to effect vehicle selection.

12. A system for managing a plurality of motor vehicles that are driven by different people, comprising:

a parking area having at least one entrance and one exit;

barrier means for securing said at least one entrance and one exit;

at least one data acquisition device, for controlling user access, disposed in front of said barrier means, as viewed in a direction of travel, of said at least one entrance and one exit;

at least one receiver, disposed in the vicinity of said barrier means, for receiving vehicle operation data that is transmitted by a transmitter that is integral with a vehicle;

a central control unit that is connected to said barrier means, said at least one data acquisition device, and said at least one receiver; and an automatic safe system for holding vehicle keys and documents, with said automatic safe system being activated by said central control unit.

13. A system for managing a plurality of motor vehicles that are driven by different people, comprising:

a parking area having at least one entrance and one exit;

barrier means for securing said at least one entrance and one exit;

at least one data acquisition device, for controlling user access, disposed in front of said barrier means, as viewed in a direction of travel, of said at least one entrance and one exit;

at least one receiver, disposed in the vicinity of said barrier means, for receiving vehicle operation data that is transmitted by a transmitter that is integral with a vehicle;

a central control unit that is connected to said barrier means, said at least one data acquisition device, and said at least one receiver; and an analog measuring device for determining and transferring to said transmitter, via an analog/digital converter, a proportional value that corresponds to contents of tank.

14. A system according to claim 11, in which said proportional value is transmitted by said transmitter as a digital value and is converted into a corresponding gallon value in said central control unit.

* * * * *